US006220575B1

(12) United States Patent
Lindsay et al.

(10) Patent No.: US 6,220,575 B1
(45) Date of Patent: Apr. 24, 2001

(54) ANCHOR ASSEMBLY FOR HIGHWAY GUARDRAIL END TERMINAL

(75) Inventors: Wilson J. Lindsay, Fort Worth, TX (US); Dennis B. Woodard, Layton, UT (US); Steven D. Easton, Richardson, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 08/375,395

(22) Filed: Jan. 18, 1995

(51) Int. Cl.[7] ..... E01F 15/04
(52) U.S. Cl. ..... 256/13.1; 404/6
(58) Field of Search ..... 256/13.1, 19, 1; 404/6, 9, 10; 188/377, 371; 293/133, 110; 403/157, 79, 2

(56) References Cited

U.S. PATENT DOCUMENTS

| | | | |
|---|---|---|---|
| Re. 29,544 | 2/1978 | Fitch | 256/13.1 |
| D. 243,323 | 2/1977 | Waldsmith | D12/169 |

(List continued on next page.)

FOREIGN PATENT DOCUMENTS

| | | | |
|---|---|---|---|
| 419214 * | 2/1967 | (CH) | 256/13.1 |
| 3708861 | 10/1988 | (DE) . | |
| 0094847 | 11/1983 | (EP) | E01F/15/00 |
| 0245042 | 11/1989 | (EP) | E01F/15/00 |
| 0435441 | 7/1991 | (EP) | E01F/15/00 |
| 0474432 | 3/1992 | (EP) | E01F/15/00 |
| 0517377 | 12/1992 | (EP) | E01F/15/00 |
| 0589605 | 3/1994 | (EP) | E01F/15/00 |
| 1567601 | 5/1969 | (FR) . | |
| 2546932 | 6/1983 | (FR) | E01F/15/00 |
| 6264421 * | 9/1994 | (JP) | 256/13.1 |
| 89/06721 | 7/1989 | (WO) | E01F/15/00 |
| 9613972 | 5/1996 | (WO) | A01K/3/00 |

OTHER PUBLICATIONS

Brian G. Pfeifer, P.E. and Dean L. Sicking, Ph.D., P.E., Development of a Metal Cutting W–Beam Guardrail Terminal, Transportation Research Report TRP–03–43–94, 1994, 59 pages. (Title Page: Interstate Steel has the "BEST").

"The ABC Terminal" brochure by Energy Absorption Systems, Inc., No Date.

"Installation Instructions for SYRO ET–2000 Guardrail End Terminal" published by SYRO, a Subsidiary of Trinity Industries, Inc. (1994).

"ET–2000 The Future of Highway Safety" published by SYRO, a Subsidiary of Trinity Industries, Inc. Dec. 1990 (Rev. Oct. 1992).

*Primary Examiner*—Harry C. Kim
(74) *Attorney, Agent, or Firm*—Baker Botts L.L.P.

(57) ABSTRACT

An anchor assembly for an end terminal assembly of a highway guardrail system to enhance the safety of a vehicle impacting either the rail face of the associated guardrail or an end of the guardrail facing oncoming traffic. The guardrail system may have a folded beam type guardrail mounted on a plurality of posts adjacent to the side of a highway. An anchor assembly is provided as part of the end terminal assembly to provide tension support as desired for the guardrail during rail face impacts and a cable anchor bracket which releases from the guardrail during a head on impact with the end of the guardrail. Also, a universal strut is provided between a first post and a second post at the end of the guardrail as part of the anchor assembly. The universal strut can be used with either a left or right lateral offset between the first post and the second post relative to the guardrail. The universal strut and cable anchor bracket allow the guardrail and end terminal assembly to properly function during vehicle impact while reducing manufacturing costs and installation procedures.

18 Claims, 5 Drawing Sheets

U.S. PATENT DOCUMENTS

| | | | | |
|---|---|---|---|---|
| 1,989,763 | | 2/1935 | McFarland | 256/13.1 |
| 2,089,929 | | 8/1937 | Brickman et al. | 256/13.1 |
| 2,091,195 | | 8/1937 | Dennebaum | 267/69 |
| 2,135,705 | | 11/1938 | Florance | 256/13.1 |
| 2,146,445 | | 2/1939 | Russert et al. | 189/29 |
| 2,735,251 | * | 2/1956 | Dlugosch | 403/157 X |
| 2,776,116 | | 1/1957 | Brickman | 256/13.1 |
| 3,450,233 | | 6/1969 | Massa | 188/1 |
| 3,519,301 | | 7/1970 | Somnitz | 293/1 |
| 3,567,184 | | 3/1971 | Yancey | 256/13.1 |
| 3,602,151 | | 8/1971 | Walker et al. | 104/256 |
| 3,643,924 | | 2/1972 | Fitch | 256/13.1 |
| 3,672,657 | | 6/1972 | Young et al. | 267/116 |
| 3,674,115 | | 7/1972 | Young et al. | 188/1 B |
| 3,680,662 | | 8/1972 | Walker et al. | 188/1 B |
| 3,695,583 | | 10/1972 | Walker et al. | 256/1 |
| 3,768,781 | | 10/1973 | Walker et al. | 256/1 |
| 3,776,520 | | 12/1973 | Charles et al. | 256/13.1 |
| 3,779,591 | | 12/1973 | Rands | 293/89 |
| 3,944,187 | | 3/1976 | Walker | 256/13.1 |
| 3,973,596 | | 8/1976 | Walker | 138/174 |
| 3,982,734 | | 9/1976 | Walker | 256/13.1 |
| 4,008,915 | | 2/1977 | Walker | 293/60 |
| 4,063,713 | | 12/1977 | Anolick et al. | 256/13.1 |
| 4,071,599 | | 1/1978 | Walker | 264/311 |
| 4,072,334 | | 2/1978 | Seegmiller et al. | 293/71 R |
| 4,073,482 | | 2/1978 | Seegmiller et al. | 267/139 |
| 4,075,473 | * | 2/1978 | Winston | 256/13.1 |
| 4,097,572 | | 6/1978 | Walker | 264/310 |
| 4,118,014 | | 10/1978 | Frosch et al. | 256/1 |
| 4,181,198 | | 1/1980 | Lindberg | 188/1 C |
| 4,274,665 | | 6/1981 | Marsh, Jr. | 285/177 |
| 4,289,419 | | 9/1981 | Young et al. | 404/6 |
| 4,295,637 | | 10/1981 | Hulek | 256/13.1 |
| 4,330,106 | | 5/1982 | Chisholm | 256/13.1 |
| 4,352,484 | | 10/1982 | Gertz et al. | 256/13.1 |
| 4,389,134 | | 6/1983 | Colas | 403/263 |
| 4,399,980 | | 8/1983 | van Schie | 256/13.1 |
| 4,452,431 | | 6/1984 | Stephens et al. | 256/13.1 |
| 4,498,803 | | 2/1985 | Quittner | 404/6 |
| 4,500,225 | | 2/1985 | Quittner | 404/6 |
| 4,531,665 | * | 7/1985 | Cale, Jr. | 403/157 X |
| 4,557,466 | | 12/1985 | Zucker | 256/13.1 |
| 4,583,716 | | 4/1986 | Stephens et al. | 256/13.1 |
| 4,607,824 | | 8/1986 | Krage et al. | 256/13.1 |
| 4,624,601 | | 11/1986 | Quittner | 404/12 |
| 4,635,981 | | 1/1987 | Friton | 293/1 |
| 4,655,434 | | 4/1987 | Bronstad | 256/13.1 |
| 4,666,130 | | 5/1987 | Denman et al. | 256/13.1 |
| 4,674,911 | | 6/1987 | Gertz | 404/6 |
| 4,678,166 | | 7/1987 | Bronstad et al. | 256/13.1 |
| 4,681,302 | | 7/1987 | Thompson | 256/13.1 |
| 4,688,766 | | 8/1987 | Zucker | 256/13.1 |
| 4,711,481 | | 12/1987 | Krage et al. | 293/133 |
| 4,784,515 | | 11/1988 | Krage et al. | 404/6 |
| 4,815,565 | | 3/1989 | Sicking et al. | 188/32 |
| 4,838,523 | | 6/1989 | Humble et al. | 256/13.1 |
| 4,844,213 | | 7/1989 | Travis | 188/377 |
| 4,909,661 | | 3/1990 | Ivey | 404/6 |
| 4,928,928 | | 5/1990 | Buth et al. | 256/13.1 |
| 4,934,661 | | 6/1990 | Denman et al. | 256/13.1 |
| 5,009,542 | | 4/1991 | Hardin, Jr. et al. | 404/6 |
| 5,022,782 | | 6/1991 | Gertz et al. | 404/6 |
| 5,078,366 | | 1/1992 | Sicking et al. | 256/13.1 |
| 5,088,874 | | 2/1992 | Quittner | 414/460 |
| 5,112,028 | | 5/1992 | Laturner | 256/13.1 |
| 5,192,157 | | 3/1993 | Laturner | 404/6 |
| 5,199,755 | | 4/1993 | Gertz | 293/120 |
| 5,203,543 | | 4/1993 | Fleury | 256/13.1 |
| 5,211,503 | | 5/1993 | Quittner | 404/6 |
| 5,238,228 | | 8/1993 | Moon | 256/13.1 |
| 5,248,129 | | 9/1993 | Gertz | 256/13.1 |
| 5,286,137 | | 2/1994 | Cicinnati et al. | 404/6 |
| 5,314,261 | | 5/1994 | Stephens | 404/6 |
| 5,348,416 | | 9/1994 | Ivey et al. | 404/6 |
| 5,391,016 | | 2/1995 | Ivey et al. | 404/6 |
| 5,403,113 | | 4/1995 | Gertz et al. | 404/6 |
| 5,407,298 | * | 4/1995 | Sicking et al. | 404/6 |
| 5,425,594 | | 6/1995 | Krage et al. | 404/6 |
| 5,490,661 | * | 2/1996 | Stevens et al. | 256/13.1 |
| 5,494,371 | | 2/1996 | Oberth et al. | 404/6 |
| 5,577,861 | | 11/1996 | Oberth et al. | 404/6 |
| 5,642,792 | | 7/1997 | June | 188/377 |
| 5,660,496 | | 8/1997 | Muller et al. | 404/6 |
| 5,733,062 | | 3/1998 | Oberth et al. | 404/6 |
| 5,765,811 | | 6/1998 | Alberson et al. | 256/13.1 |
| 5,775,675 | | 7/1998 | Sicking et al. | 256/13.1 |
| 5,797,592 | | 8/1998 | Machado . | |
| 5,851,005 | | 12/1998 | Muller et al. | 256/13.1 |
| 5,868,521 | | 2/1999 | Oberth et al. | 404/6 |
| 5,924,680 | | 7/1999 | Sicking et al. | 256/13.1 |
| 6,022,003 | * | 2/2000 | Sicking et al. | 256/13.1 |

* cited by examiner

ANCHOR ASSEMBLY FOR HIGHWAY GUARDRAIL END TERMINAL

TECHNICAL FIELD OF THE INVENTION

This invention relates to an anchor assembly for an end terminal of a highway guardrail system having a guardrail mounted on posts with the end terminal assembly designed to meet applicable federal and state standards including but not limited to crash worthiness requirements.

BACKGROUND OF THE INVENTION

Along most highways there are hazards which present substantial danger to drivers and passengers of vehicles if the vehicles leave the highway. To prevent accidents from a vehicle leaving the highway, guardrails are often provided along the side of the highway. Experience has shown that guardrails should be installed such that the end of the guardrail facing the flow of oncoming traffic does not present another hazard more dangerous than the original hazard requiring installation of the guardrail. Early guardrails often had no protection at the end facing the oncoming traffic. Sometimes impacting vehicles became impaled on such guardrail ends causing extensive damage to the vehicle and severe injury to the driver and/or passengers. In some reported cases, the guardrail penetrated directly into the passenger compartment of the vehicle fatally injuring the driver and passengers.

Various guardrail designs and end terminal assemblies have been developed to minimize the consequences resulting from impact between a vehicle and the end of a guardrail. These designs include tapering the end of the guardrail into the ground to eliminate potential contact with the end of the guardrail. Other types of end terminal assemblies include breakaway cable terminals (BCT), vehicle attenuating terminals (VAT), the Sentre end treatment, and breakaway end terminals (BET).

It is desirable for an end terminal assembly to be usable at any end of a guardrail as a means of both attenuating a head on impact as well as providing an effective anchor for an impact along the side of the guardrail downstream from the end terminal assembly. Examples of such end terminal assemblies are shown in U.S. Pat. No. 4,928,928 entitled Guardrail Extruder Terminal, and U.S. Pat. No. 5,078,366 entitled Guardrail Extruder Terminal. Both patents are incorporated by reference for all purposes within this application.

SUMMARY OF THE INVENTION

In accordance with the present invention, disadvantages and problems associated with previous anchor assemblies for end terminals used to minimize damage to a vehicle caused by colliding with the end of a highway guardrail have been substantially reduced or eliminated. The present invention provides an anchor assembly having a cable anchor assembly and a universal offset strut which substantially reduce manufacturing costs for the associated end terminal assembly while at the same time allowing the end terminal assembly to effectively anchor the guardrail during a downstream rail face impact and to function satisfactorily during a head on impact with the end of the guardrail without excessive damage to the vehicle.

An end terminal assembly is provided for one end of a guardrail facing oncoming traffic to substantially enhance the safety of a vehicle impacting at or near the end of the guardrail. An end terminal assembly incorporating the present invention may be used with a guardrail mounted on a plurality of breakaway posts made from wood or other suitable types of material. A first post is provided adjacent to the end of the guardrail and a second post is provided spaced longitudinally from the first post and laterally offset from the guardrail. A universal strut is disposed between the first post and the second post with first and second yokes oriented relative to an elongated member to allow securing the universal strut with the first post and the second post when the lateral offset is either to the right or to the left of the guardrail.

An end terminal assembly incorporating an anchor assembly of the present invention may include a kinetic energy absorbing assembly such as an extruder terminal that dissipates impact energy by squeezing a W-beam guardrail into a relatively flat plate and bending the flattened guardrail in an arc directed away from the impacting vehicle. Other types of kinetic energy absorbing assemblies may be satisfactorily used with an end terminal assembly having the anchor assembly of the present invention. Alternatively, an anchor assembly incorporating the teachings of the present invention may be satisfactorily used with an end terminal assembly which does not include a kinetic energy absorbing assembly.

An anchor assembly of the present invention preferably includes a cable anchor assembly having a cable and a cable anchor bracket which provide desired tension support for the guardrail during a side impact or downstream guardrail face impact between a vehicle and the guardrail. The cable anchor bracket includes a plurality of tabs or partial cutouts which extend at an acute angle from the exterior of the cable anchor bracket. Each tab is inserted into a corresponding aperture in the guardrail at a location downstream from the first post on which the guardrail is mounted. One end of the cable is secured to the first post and the other end secured to the cable anchor bracket. The tabs have a tapered or angled configuration such that upon engagement of the cable anchor bracket by the kinetic energy absorbing assembly or other components of the end terminal assembly during a head on impact by a vehicle, the cable anchor bracket releases from the apertures in the guardrail and thus avoids preventing the end terminal assembly from safely functioning during the head on impact.

Technical advantages of the present invention include providing an end terminal assembly for a highway guardrail that is less expensive to manufacture than prior designs and easier to install. A major portion of the cable anchor bracket can be fabricated from a single piece of sheet metal using conventional metal bending and stamping techniques in accordance with the teachings of the present invention. A universal strut incorporating the teachings of the present invention may be used with an end terminal assembly having a second post with either a right or left lateral offset relative to a first post.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

The preferred embodiments of the present invention and its advantages are best understood by referring to the FIGS. 1–11 of the drawings, like numerals being used for like and corresponding parts of the various drawings.

Figure 1:
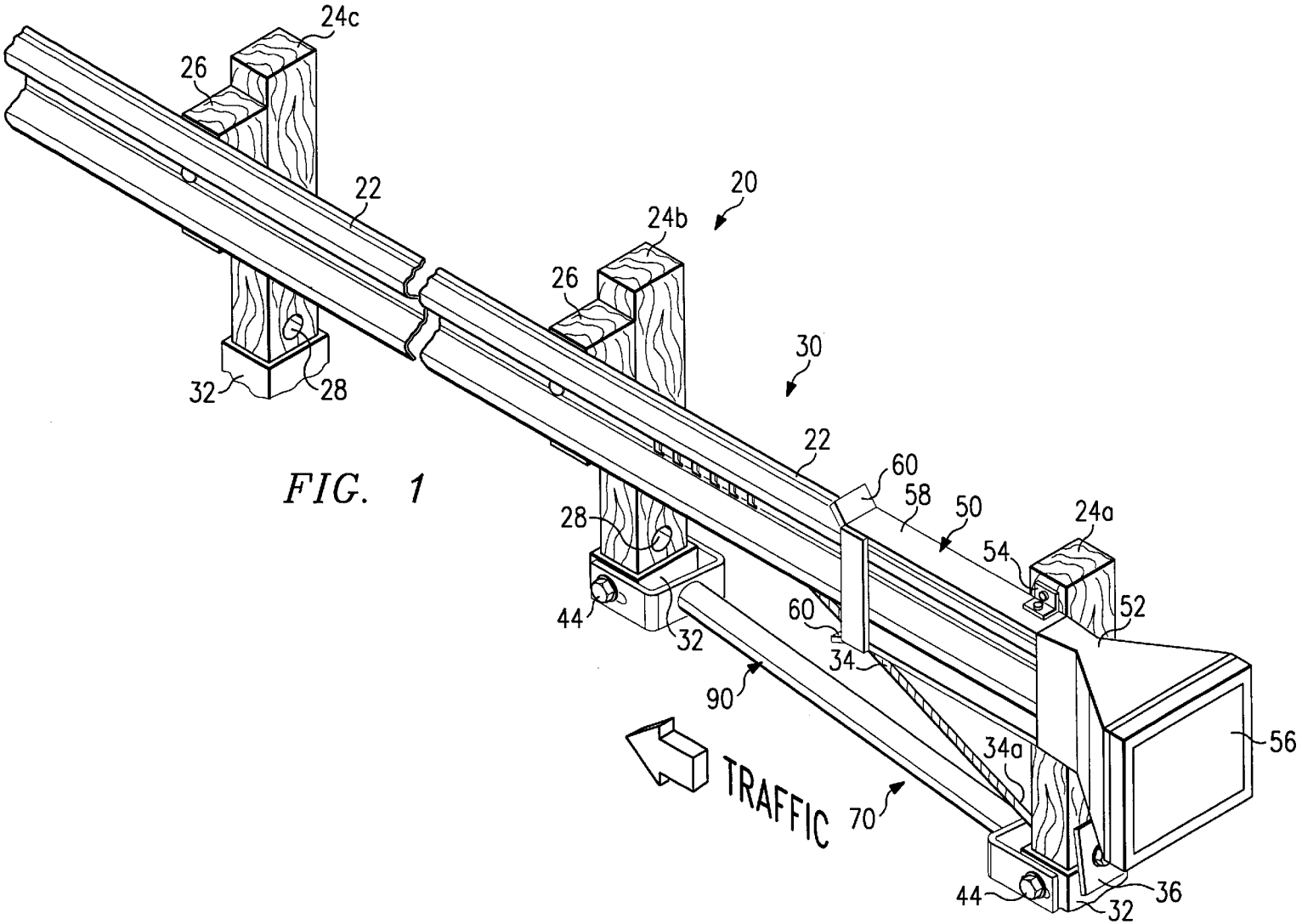
FIG. 1 is an isometric drawing with portions broken away showing a highway guardrail system having an end terminal assembly and an anchor assembly incorporating teachings of the present invention.
Figure 3:
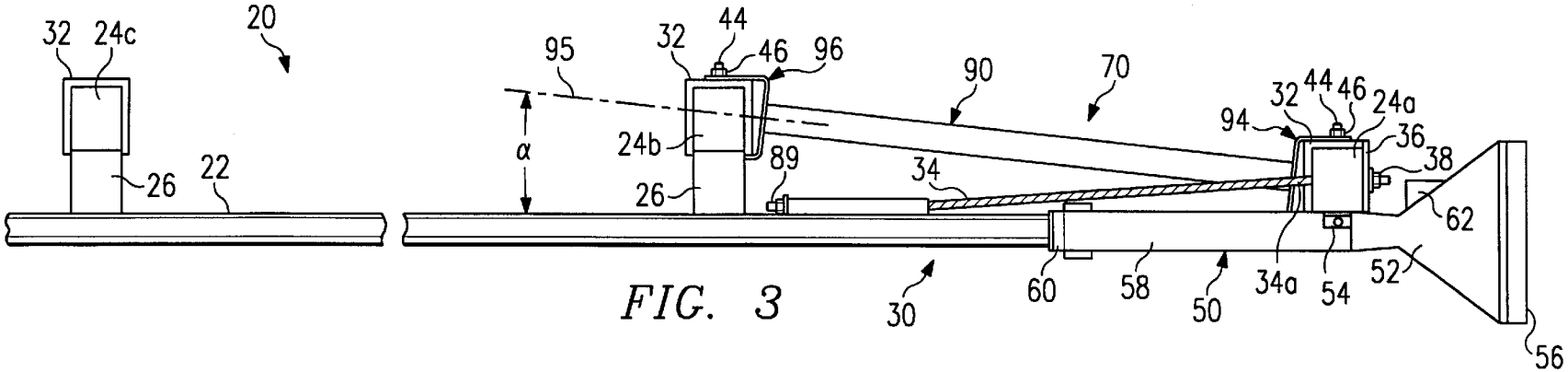
FIG. 3 is a top plan view with portions broken away of the guardrail system shown in FIG. 1.
Figure 2:
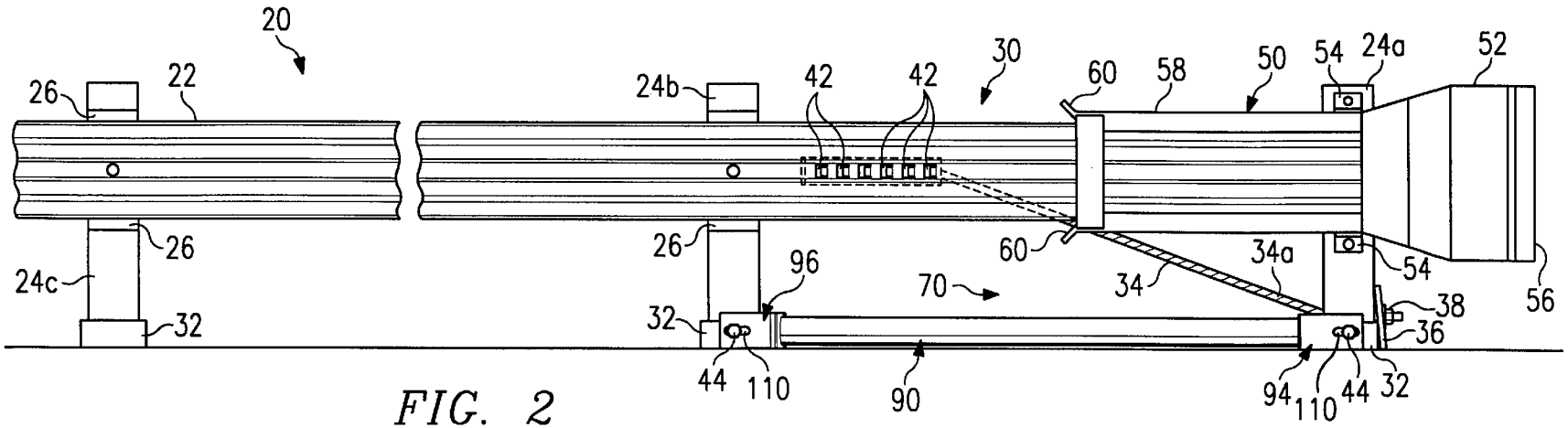
FIG. 2 is a side view with portions broken away of the guardrail system shown in FIG. 1.

Guardrail system 20 with end terminal assembly 30 incorporating teachings of the present invention is shown generally in FIGS. 1, 2 and 3. Guardrail system 20 will typically be installed along the side of a highway (not shown) adjacent to a hazard (not shown) to prevent a vehicle (not shown) from leaving the highway. Guardrail system 20 preferably includes guardrail 22 mounted on a plurality of posts 24. In FIG. 1 only three posts 24*a*, 24*b* and 24*c* are shown. However, the number of posts and the length of guardrail 22 depends upon the length and other characteristics associated with the hazard adjacent to the highway requiring installation of guardrail system 20.

As shown in FIGS. 1, 2 and 3, posts 24*a*, 24*b*, and 24*c* are preferably made from wood or other suitable types of breakaway material. The types of material which may be satisfactorily used to manufacture posts with the desired strength and/or break-away characteristics appropriate for the specific guardrail system, location of each post and roadside hazard include but are not limited to wood, steel, composite materials and various types of plastics.

Steel foundation tubes 32 may be placed in the ground adjacent to the shoulder of the highway at the desired location for end terminal assembly 30. Post 24*a*, 24*b* and 24*c* are then inserted into their respective foundation tube 32. Various techniques which are well known in the art may be used to satisfactorily install foundation tubes 32 and posts 24 depending upon the type of soil conditions and other factors associated with the highway and the hazard requiring installation of guardrail system 20. In addition to foundation tubes 32, other types of post-to-ground installation systems such as concrete with steel slip base posts and direct drive breakaway posts may be satisfactory used with end terminal assembly 30 incorporating teachings of the present invention.

For some applications, eight wooden posts 24 may be installed respectively in foundation tubes 32. Other applications may require the use of only four wooden posts 24 installed respectively in foundation tubes 32. The remaining posts (not shown) associated with guardrail system 20 will typically be installed adjacent to the highway without the use of foundation tubes 32. These additional posts may be made from wood, steel or any other suitable material.

First post 24*a* is connected to guardrail 22 adjacent to the end of guardrail 22 facing the oncoming traffic. Second post 24*b* is connected to guardrail 22 spaced longitudinally from first post 24*a* with block 26 disposed therebetween. Similar blocks 26 are preferably disposed between post 24*c* and the other posts (not shown) used to support guardrail 22. During a rail face impact between a vehicle and guardrail 22 downstream from end terminal assembly 30, blocks 26 provide a lateral offset between their respective posts and guardrail 22. The distance and direction of the lateral offset is selected to prevent the wheels (not shown) of the vehicle from striking one or more posts during the rail face impact. Thus, second post 24*b* is preferably installed longitudinally spaced from first post 24*a* and laterally offset from guardrail 22 away from the direction of the traffic flow.

As shown in FIG. 1, hole 28 is preferably formed in posts 24*a*, 24*b*, 24*c*, and any other posts associated with end terminal assembly 30 to help provide the desired breakaway characteristics required for the specific guardrail system 20. Holes 28 in posts 24*a*, 24*b* and 24*c* should be aligned parallel with the highway. As previously noted, posts 24*a*, 24*b* and 24*c* are preferably inserted into steel foundation tubes 32 which cooperate with holes 28 to establish uniform breakaway characteristics for the respective posts 24*a*, 24*b* and 24*c*. For most applications when guardrail system 20 and end terminal assembly 30 are installed in line with the edge of a highway, a taper of approximately 50:1 is recommended so that portions of end terminal assembly 30 such as kinetic energy absorbing assembly 50 will not encroach onto the shoulder of the highway.

Guardrail system 20 is primarily designed and installed along a highway to withstand a rail face impact from a vehicle downstream from end terminal assembly 30. Anchor assembly 70 including cable 34, cable anchor bracket 71, and strut 90 are included as a part of end terminal assembly 30 to provide the desired amount of tension anchoring or support for guardrail 22 during such rail face impact from a downstream vehicle collision. Cable 34 is preferably a breakaway type cable associated with highway guardrail systems and is selected to provide the desired tension strength for guardrail 22 during such rail face impact.

First portion 34*a* of cable 34 is preferably secured with first post 24*a* using plate 36 and nut 38. Second portion 34*b* at the opposite end of cable 34 is preferably secured to cable anchor bracket 71. As will be explained later in more detail, a plurality of tabs 68 extend outwardly at an acute angle from cable anchor bracket to releasably anchor second portion 34*b* of cable 34 with a plurality of apertures 42 formed in guardrail 22 between first post 24*a* and second post 24*b*. Strut 90 is preferably installed between and connected to first post 24*a* and second post 24*b* to provide additional structural support for cable 34 and guardrail 22 during downstream rail face impacts. The functions of anchor assembly 70 will be discussed later in more detail.

End terminal assembly 30 incorporating the teachings of the present invention is provided to minimize or eliminate the potential for a serious accident from a head on collision with the end of guardrail 22 facing oncoming traffic. For some applications end terminal assembly 30 may include kinetic energy absorbing assembly 50 to prevent guardrail 22 from piercing the vehicle and the passenger compartment or causing the vehicle to either roll over or vault guardrail system 20.

For purposes of illustrating some of the features of the present invention, end terminal assembly 30 is shown in conjunction with guardrail 22 having a typical W-beam configuration with kinetic energy absorbing assembly 50 disposed on the end of guardrail 22 adjacent to first post 24*a* facing oncoming traffic. In the event of a collision between a vehicle and the end of guardrail system 20, kinetic energy absorbing assembly 50 is provided to dissipate the impact energy of the vehicle without creating a dangerous condition. Anchor assembly 70 incorporating the teachings of the present invention may be satisfactorily used with an end terminal assembly that does not include kinetic energy absorbing assembly 50.

Kinetic energy absorbing assembly 50 as illustrated in FIGS. 1, 2 and 3 comprises an extruder terminal 52 which will dissipate the energy of a vehicle impacting the end of guardrail system 20 by flattening W-beam guardrail 22 and bending flattened guardrail 22 in an arc away from the highway and the impacting vehicle. Extruder terminals satisfactory for use with the present invention are described in more detail in U.S. Pat. Nos. 4,928,928 and 5,078,366. One or more brackets 54 are provided to releasably secure extruder terminal 52 with first post 24*a* prior to impact by a vehicle.

Extruder terminal 52 includes front striking plate 56 and feeder chute 58. During a collision, feeder chute 58 functions as a guide to direct guardrail 22 into extruder terminal 52. Feeder chute 58 also keeps extruder terminal 52 from rotating relative to guardrail 22 during an impact or collision. If extruder terminal 52 were to rotate during impact, guardrail 22 would no longer feed into extruder terminal 52 resulting in an immediate deceleration of the impacting vehicle and potentially causing a very dangerous condition.

During the initial impact and movement of extruder terminal 52 down the length of guardrail 22, posts 24*a* and 24*b* may also tend to bend or rotate. In addition to providing increased structural support as part of anchor assembly 70, strut 90 also helps to minimize such possible bending or rotation of first post 24*a* and second post 24*b*.

Feeder chute 58 includes guides 60 that prevent shaving of guardrail 22 by the ends of feeder chute 58 as feeder chute 58 moves down the length of guardrail 22 during a head on collision with striker plate 56. Guides 60 accommodate any irregularities or bumps in guardrail 22 to ensure proper feeding of guardrail 22 into extruder terminal 52.

Extruder terminal 52 includes an inlet that is preferably four inches wide. This compares with the width of a typical W-beam guardrail of approximately three and one quarter inch. As guardrail 22 moves into extruder terminal 52, it is flattened from approximately three and one quarter inches wide to approximately one inch wide. As this flattening process occurs, substantial energy is dissipated slowing the impacting vehicle. Once guardrail 22 is flattened, the bending strength of guardrail 22 is eliminated or substantially reduced. As extruder terminal 52 moves further down guardrail system 20, flattened guardrail 22 is forced through a bending chute (not shown). As flattened guardrail 22 moves along the bending chute, it is bent into an arc in a direction away from the impacting vehicle and exits extruder terminal 52 through outlet 62.

Prior to impact with a vehicle, cable 34 is taunt with first portion 34*a* secured with first post 24*a* and tabs 68 inserted into corresponding apertures 42 to releasably secure cable anchor bracket 71 with guardrail 22. Following an initial head on impact of a vehicle with front striker plate 56 and the initiation of flattening and bending of guardrail 22, the impacting vehicle and extruder terminal 52 engage first post 24*a* breaking it at the top of the associated foundation tube 32. Breaking first post 24*a* will release first portion 34*a* of cable 34. As feeder chute 58 continues moving down guardrail 22 during the collision, it will engage cable anchor bracket 71. Since the tension in cable 34 has been released, engagement of feeder chute 58 with cable anchor bracket 71 moves tabs 68 out of their associated apertures 42 releasing cable anchor bracket 71 and second cable portion 34*b* from guardrail 22. Cable 34 and cable anchor bracket 71 can now move out of the path of extruder terminal 52 and avoid possibly blocking the movement of extruder terminal 52.

Figure 4:
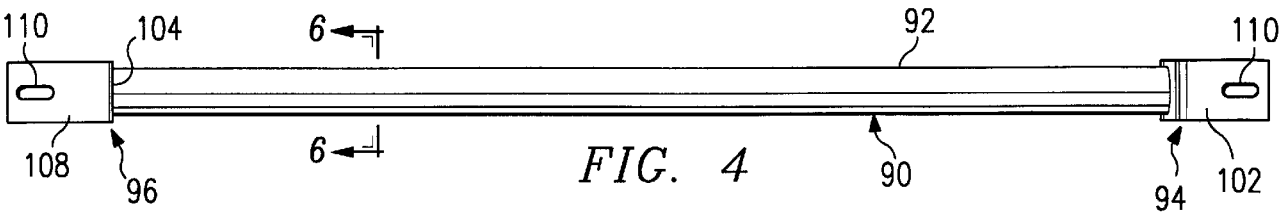
FIG. 4 is an enlarged side view of a strut showing one embodiment of the present invention.
Figure 5:
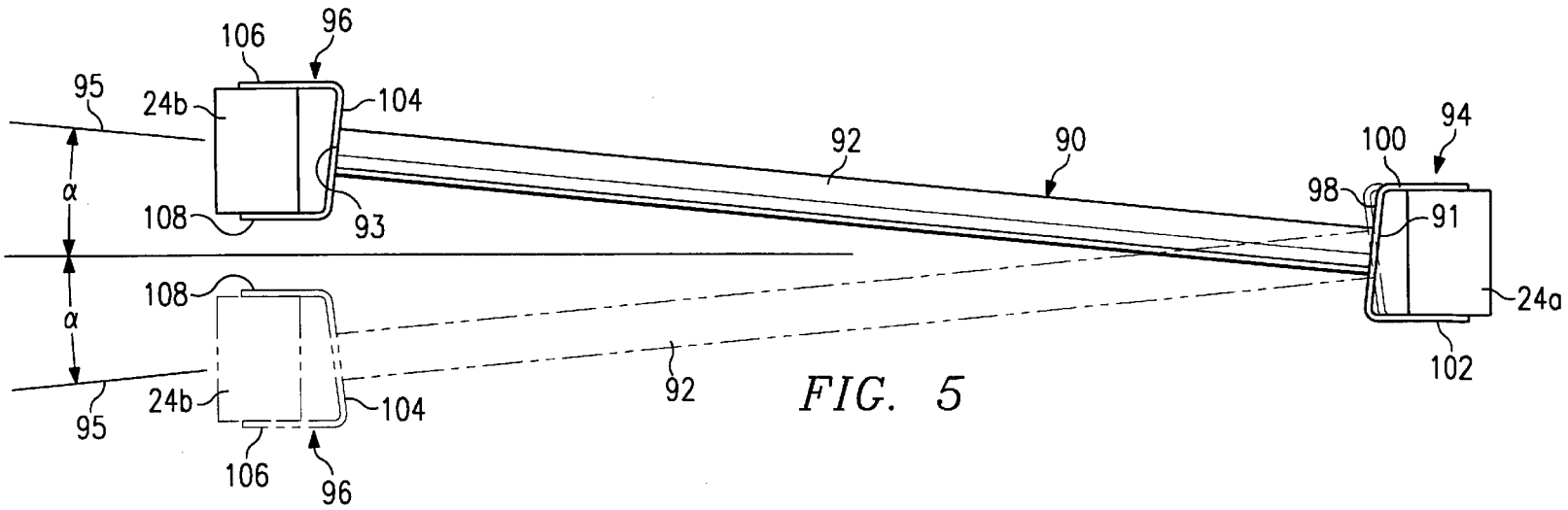
FIG. 5 is a plan view of the strut shown in FIG. 4 illustrating alternative orientations of the strut with respect to a first post and a second post.
Figure 6:
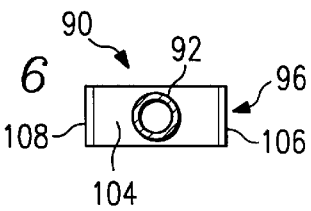
FIG. 6 is a drawing in section taken along lines 6—6 of FIG. 4.

As best shown in FIGS. 4, 5 and 6, strut 90 is preferably formed from an elongated tubular member 92 having a generally circular cross section. First yoke 94 and second yoke 96 are preferably formed from generally rectangular strips of metal (not shown) each having approximately the same dimensions as desired for yokes 94 and 96. Conventional metal working techniques such as bending and/or stamping may be used to form each yoke 94 and 96 from its respective strip of metal. Substantial manufacturing cost may be saved and installation procedures simplified by forming first yoke 94 and second yoke 96 with the same dimensions.

First yoke 94 preferably includes middle portion 98 having a first prong 100 and a second prong 102 extending therefrom. In the same manner, second yoke 96 preferably has a corresponding middle portion 104, first prong 106, and second prong 108. Longitudinal slots 110 are provided in each prong 100, 102, 106 and 108. Bolt 44 may be extended through respective slots 110 to attach first yoke 94 with first post 24*a* and its associated foundation tube 32. In a similar manner, slots 110 allow another bolt 44 to be inserted through second yoke 96, second post 24*b* and its associated foundation tube 32. Strut 90 is preferably installed immediately adjacent to the ground line.

As previously noted, second post 24*b* is often installed with a lateral offset from guardrail 22 and thus first post 24*a*. As shown in FIG. 3, this offset results in the longitudinal axis of strut 90 extending at an acute angle $\alpha$ relative to guardrail 22 when strut 90 is attached to posts 24*a* and 24*b*. First end 91 and second end 93 of elongated tubular member 92 are preferably cut or formed parallel with each other at an acute angle relative to longitudinal axis 95 of elongated tubular member 92. The acute angle defined by ends 91 and 93 with respect to longitudinal axis 95 should be approximately equal to acute angle $\alpha$.

First prong 100 and second prong 102 are preferably formed parallel with each other and extending at an acute angle relative to middle portion 98. This acute angle is also selected to be approximately equal to acute angle $\alpha$. In the same manner, second yoke 96 is formed with first prong 106 and second prong 108 extending parallel with each other and defining approximately the same acute angle $\alpha$ relative to middle portion 104. Thus, as best shown in FIG. 5, the same strut 90 may be used when second post 24*b* is laterally offset in either direction with respect to guardrail 22. Prior to the present invention, separate right hand struts and left hand struts were generally required depending upon the direction of the lateral offset of second post 24*b* from the associated guardrail.

Figure 7:
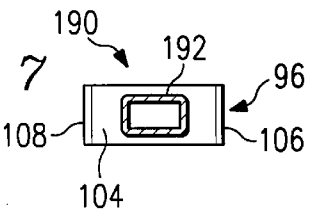
FIG. 7 is a drawing in section with portions broken away showing a strut incorporating an alternative embodiment of the present invention.

As best shown in FIG. 6, elongated tubular member 92 preferably has a generally circular cross section. Thus strut 90 may be fabricated from relatively low-cost sections of tubing and/or pipe having the desired strength characteristics required for anchor assembly 70. For other applications, strut 190 as shown in FIG. 7 may be satisfactorily used with anchor assembly 70. Strut 190 preferably includes first yoke 94 and second yoke 96 as previously described with respect to strut 90. Only yoke 96 is shown in FIG. 7. Strut 190 preferably includes an elongated tubular member 192 which may be substantially similar to elongated tubular member 92 except elongated tubular member 192 has a generally rectangular cross section as compared to the generally circular cross section of elongated tubular member 92.

For both strut 90 and strut 190 the respective elongated tubular members 92 and 192 are shown as having a generally hollow cross section. For some applications it may be desirable to use a solid elongated member with first yoke 94 and second yoke 96 attached thereto. Also, elongated members having a cross section other than circular or rectangular may be satisfactory used with the present invention. An important feature of the present invention is the ability to use various types of elongated tubular members between first yoke 94 and second yoke 96 as long as the cross section of the selected tubular member provides the desired characteristics to allow the resulting strut to be used with second post 24*b* having a lateral offset in either direction with respect to first post 24*a* and guardrail 22.

First portion 34*a* of cable 34 may be inserted into hole 28 in first post 24*a*. Plate 36 and nut 38 may be used to fasten first portion 34*a* of cable 34 with first post 24*a*. As shown in more detail in FIGS. 8 and 10, second portion 34*b* of cable 34 may be disposed within and fastened to either cable anchor bracket 71 or 171. For the embodiment of the present invention shown in FIG. 8, cable anchor bracket 71 preferably includes elongated member 72 having a first side 74, second side 76 and a third side 78 which cooperate with each other to define cable receiving channel 80 having a generally open U-shaped cross section.

Figures 8, 9:
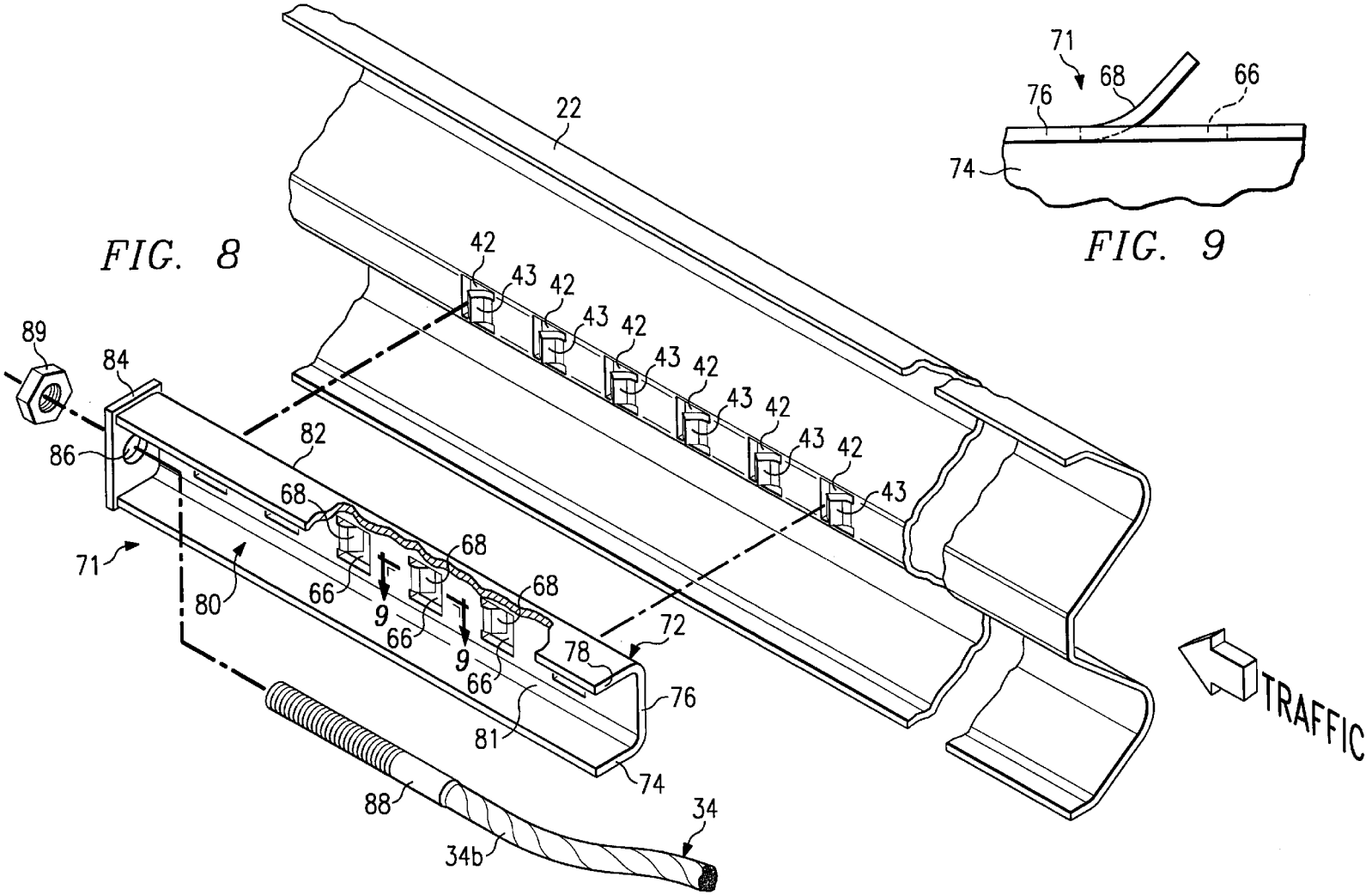
FIG. 8 is an enlarged, exploded drawing showing portions of a cable, a cable anchor bracket and an associated guardrail incorporated one embodiment of the present invention.
FIG. 9 is an enlarged drawing in section with portions broken away taken along lines 9—9 of FIG. 8 showing one of the tabs formed in the cable anchor bracket of FIG. 8.

For one application, elongated member 72 may be fabricated from a single piece of generally rectangular sheet metal (not shown) by forming a first longitudinal bend 81 and a second longitudinal bend 82 extending approximately parallel with each other to provide first side 74, second side 76 and third side 78 of cable receiving channel 80. The resulting elongated member 72 provides cable receiving channel 80 with a generally U-shaped cross section and one open longitudinal side as shown in FIG. 8. The open longitudinal side allows second portion 34*b* of cable 34 to be readily disposed therein.

Plate 84 with opening 86 extending therethrough is preferably attached to one end of cable receiving channel 80. Threaded cable termination 88 provided on second portion 34*b* may be inserted through opening 86. Nut 89 is used with threaded cable termination 88 and plate 84 to fasten second portion 34*b* of cable 34 with cable anchor bracket 71.

A plurality of tabs 68 are preferably formed as an integral part of second side 76 of cable receiving channel 80. Each tab 68 preferably extends at an angle of approximately forty-five degrees (45°) relative to the exterior of elongated member 72. As shown in FIG. 8, tabs 68 may be formed by using conventional metal stamping techniques which result in a plurality of openings or partial cutouts 66 with respective tabs 68 extending therefrom. The width of each tab 68 is less than the width of the respective cutout 66.

Using similar metal working techniques, a plurality of apertures 42 and associated tabs 43 may be formed in the portion of guardrail 22 which will be disposed intermediate first post 24*a* and second post 24*b*. Tabs 43 preferably extend from guardrail 22 in a direction opposite from the flow of traffic and are formed at approximately the same forty-five degrees (45°) angle as tabs 68 of cable anchor assembly 70. Also, tabs 43 may be formed with a width less than the associated aperture 42.

Tabs 68 and their respective openings 66 cooperate with corresponding tabs 43 and their respective apertures 42 to allow cable anchor bracket 71 and second portion 34*b* of cable 34 to be releasably anchored with guardrail 22. Nut 89 and threaded cable terminal 88 along with nut 38 may be tightened using conventional techniques to place the desired amount of tension on cable 34 and thus guardrail 22 during the installation of end terminal assembly 30.

Figures 10, 11:
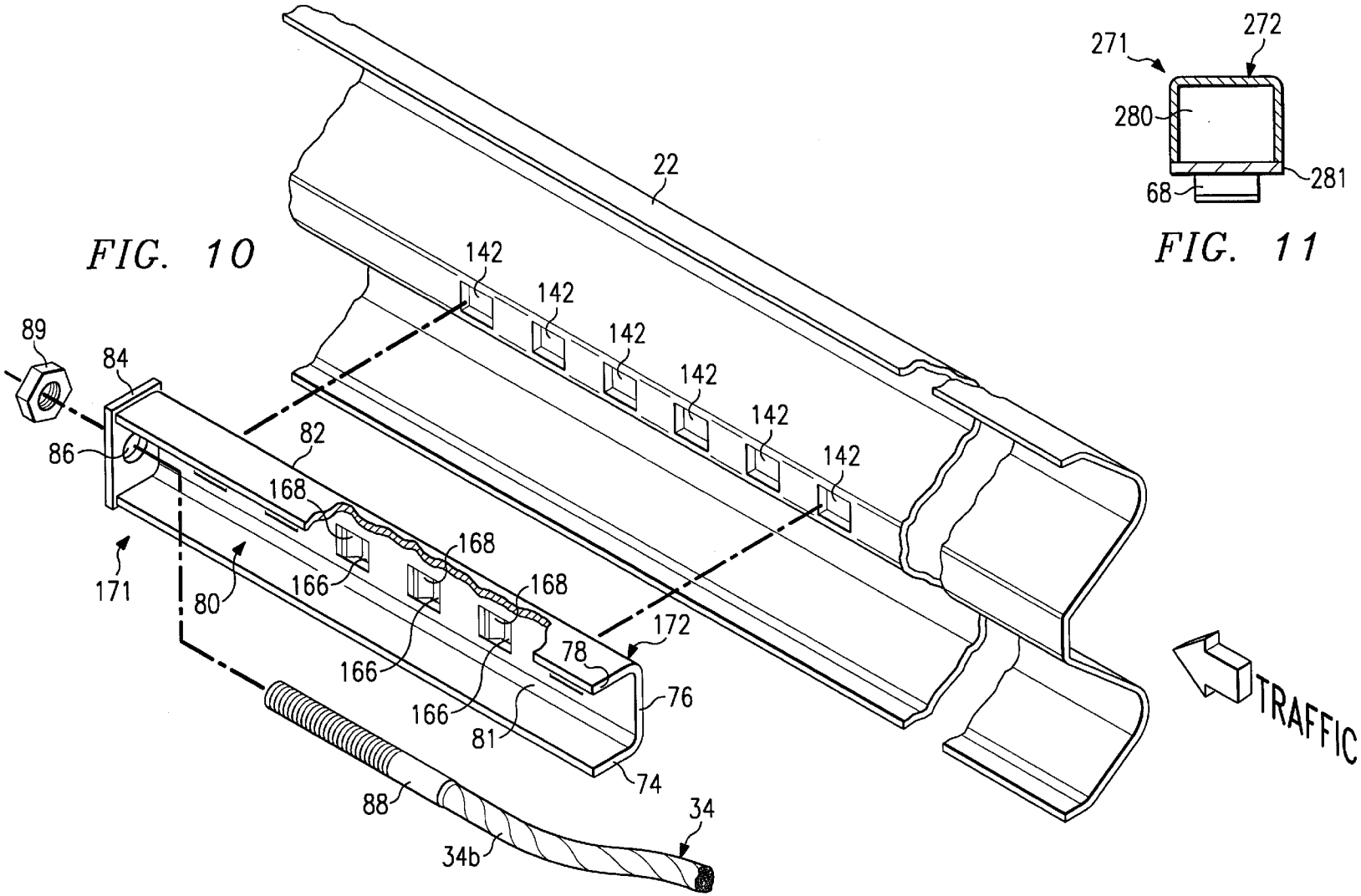
FIG. 10 is an enlarged, exploded drawing showing portions of a cable, cable anchor bracket and an associated guardrail incorporating a further embodiment of the present invention.
FIG. 11 is a drawing in section with portions broken away showing a cable anchor bracket incorporating still another embodiment of the present invention.

Cable anchor bracket 171 incorporating another embodiment of the present invention is shown in FIG. 10. Cable anchor bracket 171 preferably includes elongated member 172 having a first side 74, second side 76, and a third side 78 which may be fabricated from a single piece of generally rectangular sheet metal as previously described with respect to elongated member 72 of cable anchor bracket 71.

Some of the differences between cable anchor bracket 71 and cable anchor bracket 171 include forming tabs 168 with essentially the same width as the associated cutout 166. As best shown in FIG. 8, the metal stamping techniques used to form tabs 68 provide a substantially relieved portion on each side of the respective tab 68. As best shown in FIG. 10, the metal stamping techniques associated with forming elongated member 172 result in each tab 168 having essentially the same width as the associated cutout 166. The resulting elongated member 172 provides cable receiving channel 80 having a generally U-shaped cross section with one open longitudinal side as previously described with respect to cable anchor bracket 71.

For some applications the portion of guardrail 22 disposed between first post 24*a* and second post 24*b* may be formed with apertures 142 as shown in FIG. 10. Apertures 142 do not include a tab 43 as shown in FIG. 8. An important feature of the present invention includes the ability to form tabs as an integral part of the associated cable anchor bracket and apertures in the associated portion of the guardrail to optimize the performance of the resulting anchor assembly while minimizing manufacturing and installation costs. FIGS. 8, 9, 10, and 11 show only representative examples of some of the many ways in which the present invention can be used to enhance the performance of an anchor assembly while reducing the overall manufacturing costs with the associated end terminal assembly.

Cable anchor bracket 271 incorporating another alternative embodiment of the present invention is shown in FIG. 11. Cable anchor bracket 271 includes cable receiving channel 280 which is defined in part by elongated member 272 and longitudinal plate 281. Cable receiving channel 280 has a generally hollow, rectangular cross section and is closed on all four longitudinal sides. Elongated member 272 may be formed from a single piece of sheet metal having a generally U-shaped cross section as previously described with respect to elongated members 72 and 172. Instead of forming tabs 68 as part of elongated member 272, tabs 68 may be formed as an integral part of longitudinal plate 281 using stamping or other appropriate techniques. Longitudinal plate 281 may then be attached to elongated member 272 to provide the desired closed, generally rectangular cross section shown in FIG. 10. One end (not shown) of cable anchor bracket 271 includes plate 84 and opening 86. The other end (not shown) of cable anchor bracket 271 is preferably open to allow inserting second portion 34*b* of cable 34.

Cable anchor brackets 71, 171 and 271 and struts 90 and 190 of the present invention meet national highway safety requirements and allow reducing the manufacturing costs of the associated end terminal assembly 30 as compared to other available end terminal assemblies.

Extruder terminal 52 has been described as first flattening guardrail 22 and then bending it in an arc away from the direction of travel of the impacting vehicle. It should be understood, however, that kinetic energy absorbing assemblies which may or may not flatten guardrail 22 can be satisfactorily used with the present invention.

A cable anchor assembly having a cable anchor bracket incorporating the teachings of the present invention may also be used with an end terminal assembly having a first post and a second post which are generally in line with each other along one side of the associated guardrail. Cable anchor brackets incorporating the present invention are not limited to use only when the second post is laterally offset from the first post.

In FIGS. 1, 2, 3, 8, and 10 guardrail system 20 is shown with a typical deep W-beam twelve gauge type guardrail 22. Other types of guardrails both folded and non-folded may be satisfactorily used with an end terminal assembly incorporating the teachings of the present invention.

Although the present invention and its advantages have been described in detail it should be understood that various changes, substitutions, and alterations can be made hereto without departing from the spirit and scope of the invention as defined by the following claims.

What is claimed is:

1. An anchor assembly for an end terminal assembly of a highway guardrail system having a guardrail with an end facing oncoming traffic and mounted on at least a first post connected to the guardrail adjacent the end of the guardrail facing oncoming traffic and a second post spaced longitudinally from the first post, the anchor assembly comprising:

a strut for disposing between the first post and the second post, the strut having an elongated, closed tubular member;

a cable anchor bracket;

a cable having a first portion for securing to the first post and having a second portion secured to the cable anchor bracket;

the cable anchor bracket having a cable-receiving channel defined in part by an elongated member having at least three sides connected respectively with each other and the second portion of the cable disposed in the cable-receiving channel;

a plate attached to one end of the cable anchor assembly with the second portion of the cable fastened to the plate; and a plurality of tabs formed as an integral part of one of the sides of the cable-receiving channel with a portion of each tab extending outwardly at an acute angle relative to the cable-receiving channel, the plurality of tabs for releasably engaging a plurality of apertures formed in the guardrail between the first post and the second post whereby the cable anchor bracket may be used to releasably secure the second portion of the cable with the guardrail to provide a desired amount of tension support for the guardrail.

2. The anchor assembly of claim 1, wherein the strut further comprises:

a first yoke attached to one end of the tubular member to engage the first post;

a second yoke attached to the other end of the tubular member to engage the second post; and wherein a portion of the first yoke and a portion of the second yoke are attached to the tubular member at an acute angle to allow the second yoke to engage the second post of a guardrail when the second post has a first or second lateral offset from the guardrail.

3. The anchor assembly of claim 1, wherein the cable anchor bracket further comprises:

the elongated member having three sides which define a generally open U-shaped cross section for the cable-receiving channel;

the plate attached to one end of the elongated member with an opening therethrough for fastening the second portion of the cable with the cable anchor assembly; and the plurality of tabs formed in the side of the elongated member disposed between the other two sides.

4. The anchor assembly of claim 1, wherein the elongated member of the cable anchor bracket further comprises:

a single piece of generally rectangular sheet metal having two longitudinal bends extending approximately parallel with each other to form the cable-receiving channel with a first side, a second side, and a third side;

the two longitudinal bends along with the first side, the second side and the third side cooperating with each other to define the open U-shaped cross section; and each tab formed in the second side of the cable-receiving channel by stamping to extend outwardly at the acute angle.

5. The anchor assembly of claim 1, wherein the cable-receiving channel has a generally open U-shaped cross section.

6. The anchor assembly of claim 1, wherein the cable-receiving channel has a generally closed rectangular cross section.

7. The anchor assembly of claim 1, wherein the elongated, closed tubular member has a longitudinal axis extending therethrough with a first end and a second end, and the strut further comprises:

a first yoke and a second yoke attached respectively to the first end and the second end of the elongated tubular member;

each end of the elongated tubular member formed at an acute angle relative to the longitudinal axis of the elongated tubular member;

each yoke having a middle portion with a first prong and a second prong extending from the middle portion;

the first prong and the second prong of each yoke extending approximately parallel with each other and at an acute angle from the respective middle portion; and the acute angle associated with the first end and the second end of the elongated tubular member approximately equal to the acute angle defined by each first prong and each second prong with the respective middle portion of each yoke.

8. The anchor assembly of claim 1 wherein the cable anchor bracket further comprises:

a plurality of cutouts formed in the cable-receiving channel;

wherein one of the tabs is formed as an integral part of the cable-receiving channel; and the width of each tab being less than its respective cutout.

9. A method of forming an end terminal assembly for a highway guardrail system including a folded beam type guardrail mounted on a plurality of posts, comprising the steps of:

providing a first post at one end of the guardrail facing oncoming traffic;

providing a second post spaced longitudinally from the first post with the second post having a first lateral offset from the guardrail;

mounting a kinetic energy absorbing assembly on the end of the guardrail facing oncoming traffic;

installing a strut attached to and extending between the first post and the second post;

forming a cable anchor bracket with a plurality of sides to partially define a cable-receiving channel for disposing the cable therein;

forming a first plurality of tabs as an integral part of one of the sides of the cable-receiving channel whereby each tab extends outwardly at an acute angle relative to the cable-receiving channel;

forming a plurality of apertures in a portion of the guardrail between the first post and the second post with the apertures sized to receive corresponding tabs of the first plurality of tabs on the cable-receiving channel;

securing a first portion of the cable to the first post and a second portion of the cable within the cable-receiving channel; and releasably securing the cable anchor bracket to the guardrail by inserting the first plurality of tabs into their corresponding apertures on the guardrail whereby contact between the kinetic energy absorbing assembly and the cable anchor bracket will result in releasing the cable from the guardrail.

10. The method of claim 9, wherein forming the cable anchor bracket and forming the plurality of tabs further comprises the steps of:

forming a first longitudinal bend in a single piece of generally rectangular sheet metal;

forming a second longitudinal bend in the single piece of sheet metal with the first longitudinal bend and the second longitudinal bend extending approximately parallel with each other to provide a first side, a second side, and a third side for the cable-receiving channel; and stamping a plurality of partial cutouts in one of the sides of the cable-receiving channel to form the first plurality of tabs extending outwardly at the acute angle from the cable-receiving channel.

11. The method of claim 9, further comprising the steps of:

forming a plate with an opening extending therethrough;

attaching the plate to an end of the cable-receiving channel;

placing a portion of the cable within the cable-receiving channel and through the opening in the plate; and fastening the portion of the cable extending through the opening to the plate.

12. The method of claim 9 further comprising the steps of:

forming the strut from an elongated tubular member having a generally circular cross section with a longitudinal axis extending therethrough;

cutting each end of the elongated tubular member at approximately the same acute angle relative to the longitudinal axis;

forming a first yoke from a generally rectangular first strip of metal and forming a second yoke from a second generally rectangular strip of metal with the first strip of metal and the second strip of metal having approximately the same dimensions;

bending the first strip of metal to form the first yoke with a middle portion and a first prong and a second prong extending from the middle portion;

bending the second strip of metal to form the second yoke with a middle portion and a first prong and a second prong extending from the middle portion;

further bending the first prong and the second prong of each yoke to extend at an acute angle from the respective middle portion of each yoke at an acute angle equaling the acute angle formed on the respective ends of the elongated tubular member; and attaching the first yoke to one end of the elongated tubular member and attaching the second yoke to the other end of the elongated tubular member whereby the first and second prongs of the first yoke and the first and second prongs of the second yoke are aligned approximately parallel with each other.

13. The method of claim 9, wherein forming the cable anchor bracket and forming a plurality of tabs further comprises the steps of:

forming a generally first elongated rectangular plate of metal;

stamping a plurality of partial cutouts in the first plate of metal to form the tabs as an integral part thereof extending outwardly at the acute angle from the cable anchor assembly;

forming a first longitudinal bend and a second longitudinal bend in a second generally rectangular sheet of metal to define an elongated channel having a generally U-shaped cross section; and attaching the first plate of metal with the second sheet of metal to form the cable-receiving channel having a generally closed rectangular cross section.

14. The method of claim 9 further comprising the step of forming the cable-receiving channel with an open U-shaped cross section.

15. The method of claim 9 further comprising the step of forming the cable-receiving channel with a closed rectangular cross section.

16. The method of claim 9 further comprising the steps of:

forming a first longitudinal bend in a single piece of generally elongated, rectangular sheet metal;

forming a second longitudinal bend in the single piece of sheet metal with the first longitudinal bend and the second longitudinal bend extending approximately parallel with each other to provide a first, a second side, and a third side for the cable-receiving channel;

stamping a plurality of partial cutouts in a generally rectangular plate to form the tabs as an integral part of and extending outwardly from the elongated, rectangular plate at the acute angle; and attaching the elongated, rectangular plate to the first side and the third side of the cable-receiving channel whereby the tabs extend outwardly from the cable-receiving channel.

17. The method of claim 9 wherein the step of forming a plurality of apertures in the portion of the guardrail further comprises the step of forming a second plurality of tabs adjacent the plurality of apertures, the second plurality of tabs being sized and configured to releasably engage the first plurality of tabs.

18. An anchor assembly for an end terminal assembly of a highway guardrail system in combination with a guardrail mounted on a plurality of posts and the anchor assembly used to provide tension support for the guardrail during a rail face impact by a vehicle downstream from the end terminal assembly, the anchor assembly comprising:

a strut formed in part from an elongated, closed tubular member having a generally circular cross section;

a first yoke attached to one end of the tubular member having a first prong, middle portion, and a second prong with the first and second prongs substantially parallel to each other and angled with respect to the middle portion;

a second yoke attached to the other end of the tubular member;

the first yoke sized to engage a first post of the plurality of posts at the end of the guardrail facing oncoming traffic and the second yoke sized to engage a second post of the plurality of posts spaced longitudinally from said first post of the plurality of posts when the second post of the plurality of posts has a first lateral offset from the guardrail;

a cable attached at one end to the first post of the plurality of posts;

a cable anchor bracket for releasably holding a second end of the cable to the guardrail; and the second yoke sized to engage the second post when the second post is spaced longitudinally from the first post with a second lateral offset from the guardrail.

* * * * *